US006276776B1

(12) United States Patent
Umezawa et al.

(10) Patent No.: US 6,276,776 B1
(45) **Date of Patent: *Aug. 21, 2001**

(54) INK-JET PRINTER AND TEMPERATURE CONTROL METHOD OF RECORDING HEAD

(75) Inventors: Masahiko Umezawa; Shinichi Omo; Akira Kuronuma; Takayuki Murata, all of Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/989,684

(22) Filed: Dec. 12, 1997

(30) Foreign Application Priority Data

Dec. 17, 1996 (JP) ..... 8-336506

(51) Int. Cl.[7] ..... B41J 29/38
(52) U.S. Cl. ..... 347/17
(58) Field of Search ..... 347/12, 14, 17

(56) References Cited

U.S. PATENT DOCUMENTS

| | | | | |
|---|---|---|---|---|
| 4,313,124 | | 1/1982 | Hara | 346/140 R |
| 4,345,262 | | 8/1982 | Shirato et al. | 346/140 R |
| 4,459,600 | | 7/1984 | Sato et al. | 346/140 R |
| 4,463,359 | | 7/1984 | Ayata et al. | 346/1.1 |
| 4,558,333 | | 12/1985 | Sugitani et al. | 346/140 R |
| 4,723,129 | | 2/1988 | Endo et al. | 346/1.1 |
| 4,740,796 | | 4/1988 | Endo et al. | 346/1.1 |
| 5,122,816 | * | 6/1992 | Poeppel | 347/14 |
| 5,594,478 | * | 1/1997 | Matsubara et al. | 347/14 |

* cited by examiner

*Primary Examiner*—John Barlow
*Assistant Examiner*—Charles W. Stewart, Jr.
(74) *Attorney, Agent, or Firm*—Fitzpatrick, Cella, Harper & Scinto

(57) ABSTRACT

When the sub-heaters of recording heads are PWM controlled in a low-temperature environment, temperatures of the recording heads are respectively detected by temperature sensors. The number of recording heads to be heating controlled is determined from the detected recording head temperatures, and a maximum duty ratio of a pulse train supplied to the sub-heater corresponding to the recording head to be heating controlled is determined in accordance with the determined number of the recording heads, so that supply timings of pulse width controlled pulse trains supplied to the sub-heaters corresponding to the recording heads to be heating controlled are not overlapped.

30 Claims, 8 Drawing Sheets

INK-JET PRINTER AND TEMPERATURE CONTROL METHOD OF RECORDING HEAD

This application is based on Patent Application Nos. 08-336,506 filed Dec. 17, 1996 in Japan, the content of which is incorporated fereinto by reference.

BACKGROUND OF THE INVENTION

1. Field of the Invention

The present invention relates to an ink-jet printer in which a plurality of recording heads are temperature controlled at an optimum recording temperature to obtain a good image quality in a low-temperature environment, and to a temperature control method of the plurality of recording heads.

2. Description of the Related Art

Heretofore, a recording head has a sub-heater, a driving signal applied to the sub-heater is pulse width modulated (PWM) in accordance with a detected present temperature of the recording head to increase the recording head temperature to an optimum temperature for printing.

For example, when making recording using four recording heads in a low-temperature environment, sub-heaters of all the recording heads are necessary to be applied with voltages by the PWM control.

For example, when a sub-heater of each recording head is applied with a voltage at a 25% duty with respect to the driving period, since the heating power supply voltage VH is applied simultaneously to all the recording heads (only area A of FIG. 8), the heating power supply voltage VH for increasing the temperature of the recording heads in area A is dropped, so that the temperature does not reach the target or desired temperature resulting in a degraded recording or the like.

SUMMARY OF THE INVENTION

An object of the present invention is to provide an ink-jet printer (print apparatus) which can solve the above prior art problems and prevent occurrence of degraded image quality due to temperatures of a plurality of recording heads in a low-temperature environment.

Another object of the present invention is to provide a temperature control method of recording head which can solve the above prior art problems and prevent degradation of image quality due to temperatures of a plurality of recording heads in a low-temperature environment.

In a first aspect of the present invention, there is provided an ink-jet printer including:

a plurality of recording heads:

heating means for respectively heating the plurality of recording heads according to a repetition of a predetermined driving period; and temperature detection means for detecting respective temperatures of the plurality of recording heads; the ink-jet printer comprising:

pulse width control means for driving the heating means in a dispersed manner in a divided driving period determined by dividing the predetermined time period in accordance with the number of the recording heads;

pulse width ratio change means for ratio changing pulse widths of pulses to be applied to the recording heads in accordance with results detected by the temperature detection means in the divided driving period.

Here, the pulse with ratio change means may make ratio change in such a way that the pulse widths are equal to each other.

In a second aspect of the present invention, there is provided an ink-jet printer including:

n (≧2) units of recording heads:

1st to n'th heating means for respectively heating the n units of recording heads;

1st to n'th temperature detection means for detecting respective temperatures of the n units of recording heads; and 1st to n'th pulse width control means for making pulse width control over the 1st to n'th heating means respectively at predetermined periods in accordance with temperatures detected respectively by the 1st to n'th temperature detection means;

the ink-jet printer comprising:

judgment means for judging which recording head is to be heating controlled in accordance with temperatures detected by the 1st to n'th temperature detection means;

unit number counting means for counting the number of units of recording heads to be heating controlled in accordance with a judgment result of the judgment means;

maximum pulse width determination means for determining a maximum pulse width of pulse train generated by pulse width control means corresponding to the recording head to be heating controlled in accordance with the number of recording heads counted by the unit number counting means;

pulse width ratio change means for respectively ratio changing the pulse width of a pulse train generated by pulse width control means corresponding to the recording head to be heating controlled in accordance with the maximum pulse width determined by the maximum pulse width determination means; and timing shift means for successively shifting timings at which the pulse trains having a pulse width ratio changed by the pulse width ratio change means are supplied respectively to the heating means corresponding to the recording head to be controlled by the maximum pulse width.

Here, the maximum pulse width may be a pulse width obtained by equally dividing the predetermined period by the number of units of recording heads counted by the unit number counting means.

In a third aspect of the present invention, there is provided an ink-jet printer comprising:

n (≧2) units of recording heads:

1st to n'th heating means for respectively heating the n units of recording heads;

1st to n'th temperature detection means for detecting respective temperatures of the n units of recording heads; and 1st to n'th pulse width control means for making pulse width control over the 1st to n'th heating means respectively at predetermined periods in accordance with temperatures detected respectively by the 1st to n'th temperature detection means;

the ink-jet printer comprising:

judgment means for judging which recording head is to be heat controlled in accordance with temperatures detected by the 1st to n'th temperature detection means;

unit number counting means for counting the number of units of recording heads to be heating controlled in accordance with a judgment result of the judgment means;

maximum duty ratio determination means for determining a maximum duty ratio of pulse train generated by pulse width control means corresponding to the recording head to be heating controlled in accordance with the number of recording heads counted by the unit number counting means;

duty ratio change means for changing a maximum duty ratio of a pulse train generated by pulse width control means corresponding to the recording head to be heating controlled in accordance with the maximum duty ratio determined by the maximum duty ratio determination means; and timing shift means for successively shifting timings at which the pulse trains having a duty ratio changed by the duty ratio change means are supplied respectively to the heating means corresponding to the recording head to be heating controlled by a time in accordance with a maximum duty ratio determined by the maximum duty ratio determination means;

The maximum duty ratio may be obtained by equally dividing the predetermined period by the number of recording heads counted by the unit number counting means and by dividing the resulting time by the predetermined period.

In the second and third aspects of the present invention, the determination means may determine a recording head having a temperature detected by the 1st to n'th temperature detection means being lower than a predetermined temperature as a recording head to be heating controlled.

The determination means may judge a recording head to be temperature controlled when recording is started.

The predetermined temperature may be an optimum recording temperature.

The ink-jet printer may further comprise recording start control means for immediately starting recording when the number of units of recording heads to be heating controlled is zero as a result of counting by the unit number counting means, and starting recording when the temperature control of recording head to be heating controlled is completed when the number is 1 or more.

In a fourth aspect of the present invention, there is provided a temperature control method for recording heads comprising the steps of:

detecting respective temperatures of a plurality of recording heads respectively having pulse width controlled heating means;

ratio changing pulse widths of pulse trains supplied to the heating means in accordance with the temperatures detected, a maximum pulse width by the ratio changing corresponding to a pulse width determined by the number of the recording heads; and successively shifting timings at which the pulse trains having ratio changed pulse widths are supplied to the heating means by the determined maximum pulse width.

Here, the ratio changing step may make ratio change in such a way that the pulse widths of the pulse trains to be supplied to the corresponding heating means are equal to each other.

In a fifth aspect of the present invention, there is provided a temperature control method for recording heads comprising the steps of:

detecting respective temperatures of a plurality of recording heads respectively having pulse width controlled heating means;

judging which recording head is a recording head to be temperature controlled in accordance with detected temperature;

determining the number of units of recording heads to be temperature controlled in accordance with the judgment result;

determining a maximum pulse width of a pulse train supplied to heating means corresponding to the recording head to be heating controlled in accordance with the determined number of recording heads;

respectively ratio changing a pulse width of the pulse train supplied to heating means corresponding to a recording head to be heating controlled in accordance with determined maximum pulse width; and successively shifting timings at which the pulse width controlled pulse trains respectively having ratio changed pulse widths are supplied respectively to heating means corresponding to the recording head to be controlled by the determined maximum pulse width.

In a sixth aspect of the present invention, there is provided a temperature control method for recording heads comprising the steps of:

detecting respective temperatures of a plurality of recording heads respectively having pulse width controlled heating means;

judging which recording head is a recording head to be temperature controlled in accordance with detected temperature;

determining the number of units of recording heads to be temperature controlled in accordance with the judgment result;

determining a maximum duty ratio of a pulse train supplied to heating means corresponding to the recording head to be heating controlled in accordance with the determined number of recording heads;

ratio changing a duty ratio of the pulse train supplied to heating means corresponding to a recording head to be heating controlled in accordance with determined maximum duty ratio; and successively shifting timings at which the pulse width controlled pulse trains having ratio changed duty ratios are supplied to heating means corresponding to the recording head to be controlled by a time in accordance with the determined maximum duty ratio.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

In the following, embodiments of the present invention will be described in detail with reference to the drawings.

The term "recording" used in the present specification means providing a recording medium not only with an image such as letters or drawings having a meaning but also with an image such as patterns having no meaning.

Further, the present invention can be applied to apparatuses such as printers, copiers, facsimiles having communication systems, word processors having a printer unit, and industrial recording apparatus combined in a composite manner with various processing devices, which make recording to recording media such as paper, yarns, fabrics, textiles, leather, metals, plastics, glass, wood, and ceramics.

<First Embodiment>

Figure 1:
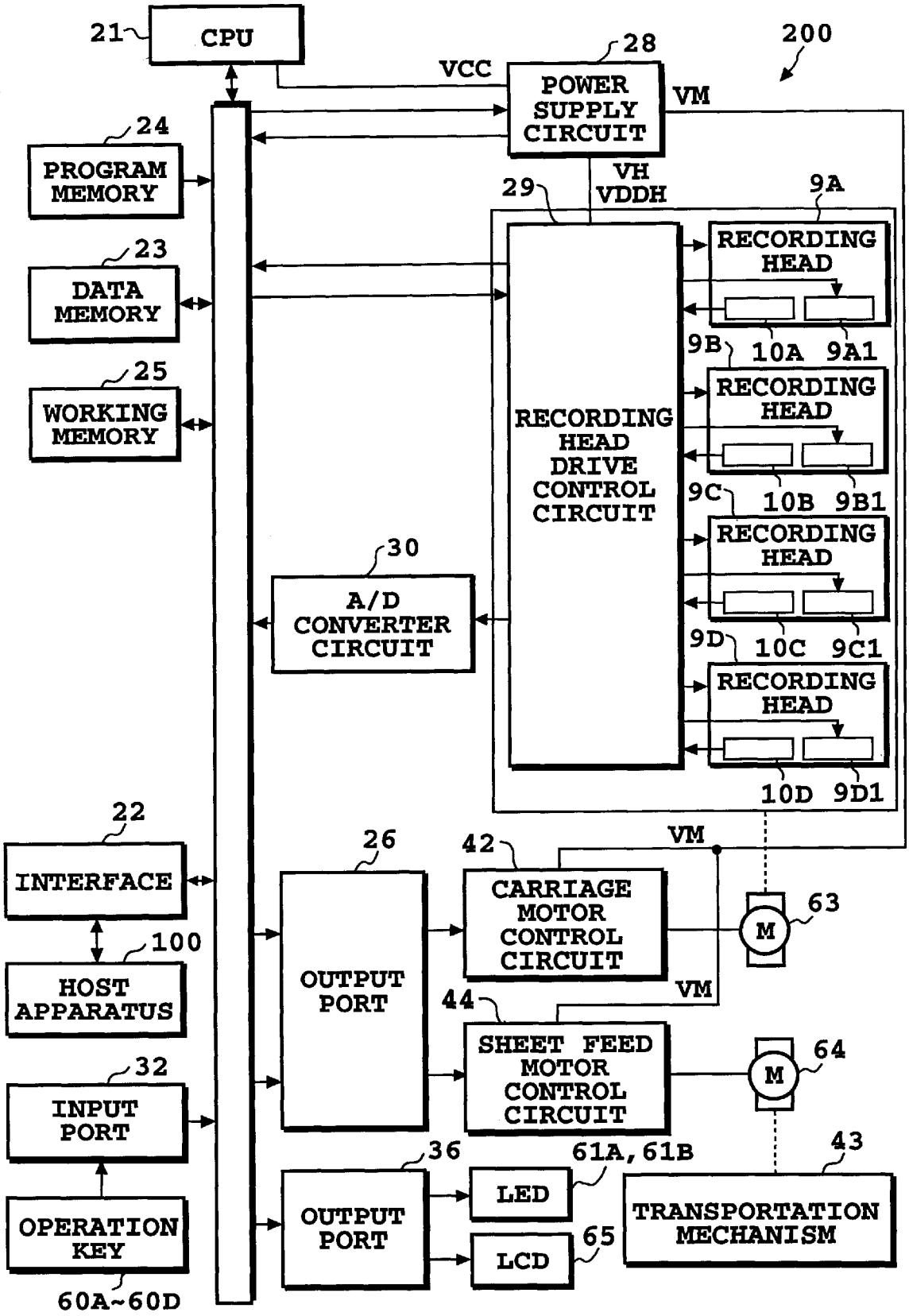
FIG. 1 is a block diagram showing a first embodiment of the present invention.

FIG. 1 shows a first embodiment of the present invention. This is an example of an ink-jet printer (print apparatus) 200. The ink-jet printer 200, as shown in FIG. 1, is connected to a host apparatus 100 through an interface 22. A part of the structure of the ink-jet printer 200 is shown in FIG. 2.

Figure 2:
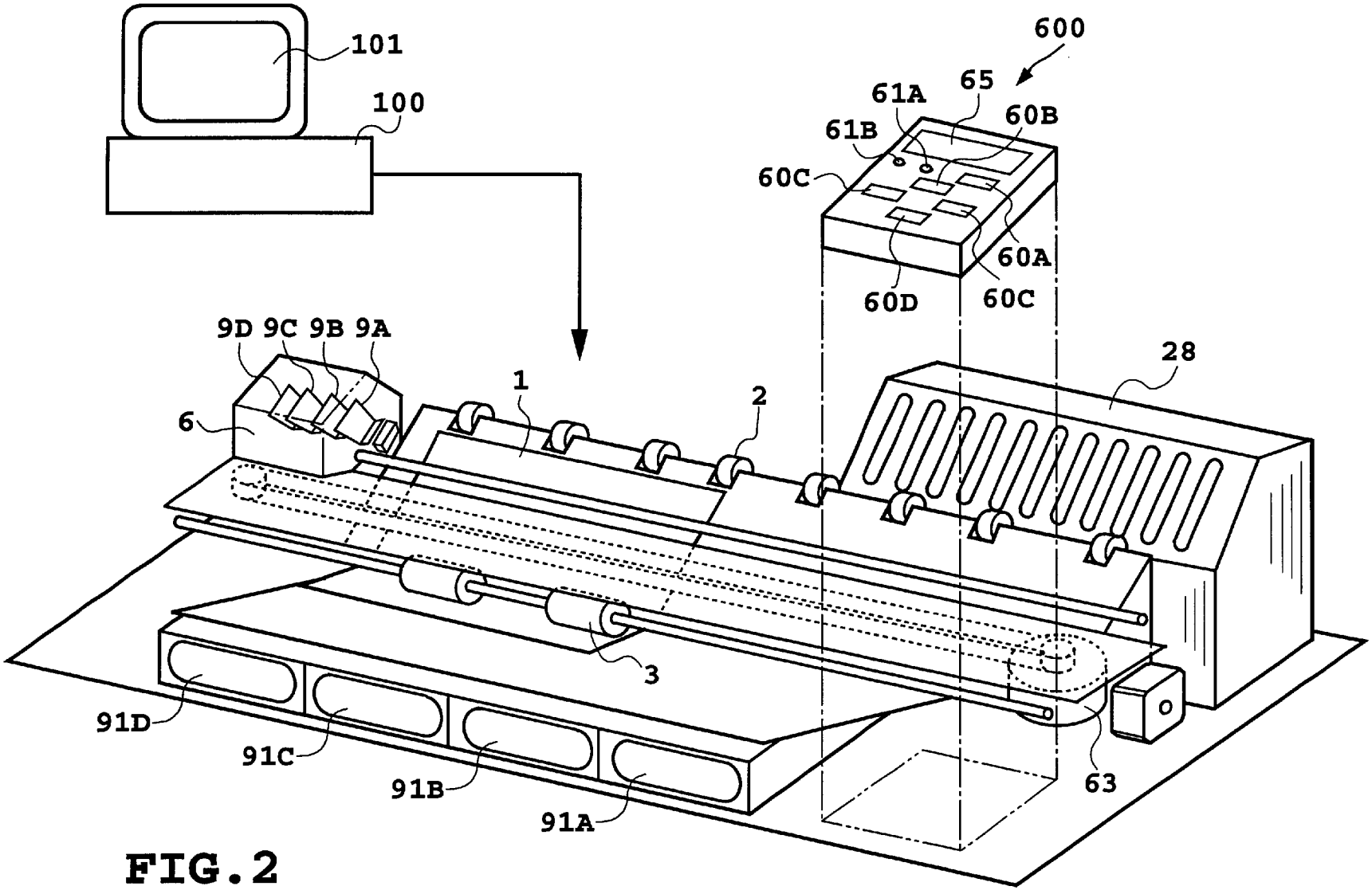
FIG. 2 is a schematic perspective view showing a part of the structure of the ink-jet print apparatus.

In FIG. 2, reference numeral 100 indicates the host apparatus for supplying image information to the ink-jet printer 200. Reference numeral 101 denotes a monitor apparatus which is connected to the host apparatus. Reference numeral 600 denotes an operation unit, which is provided with operation keys 60A to 60D, LED (light emitting diode) displays 61A and 61B, and a LCD (liquid crystal display) display 65. Reference numeral 6 denotes a carriage unit, equipped with recording heads 9A to 9D. 91A to 91D denote ink tanks. Reference numeral 2 denotes a pinch roller, for pressing a loaded recorded medium 1. Reference numeral 2 denotes a paper discharge roller for discharging the recorded medium 1. Reference numeral 28 denotes a power supply circuit, which supplies a power supply voltage VCC, a heating power supply voltage VH, a logic power supply voltage VDDH, and a motor power supply voltage VM. Reference numeral 63 denotes a carriage motor for driving the carriage unit 6.

In FIG. 1, the portions 9A to 9D, 28, 60A to 60D, 61A, 61B, 63, 95, and 100 indicate the corresponding parts in FIG. 2. A CPU 21, a program memory 23, a working memory 25, the interface 22, an input port 32, output ports 26 and 36, an A/D (analog-to-digital) converter circuit 30, a recording head drive control circuit 29, and the power supply circuit 28 are connected to each other through a bus.

The program memory 24 is in the form of ROM (read only memory) which stores a control program. The data memory 23 is in the form of EEPROM (electrically erasable and programmable ROM) for storing data. The working memory 25 is in the form of RAM (random access memory) used for working.

9A1 to 9D1 denote sub-heaters for heating the respective recording heads 9A to 9D. 10A to 10D are temperature sensors for detecting temperatures of the respective recording heads 9A to 9D.

Reference numeral 42 denotes a carriage motor control circuit, which drive controls the carriage motor 63 in accordance with a control signal from the CPU 21 obtained through the output port 26. Reference numeral 43 denotes a transportation mechanism for transporting a recorded paper 1. Reference numeral 64 denotes a sheet feed motor, which drives the transportation mechanism 43. Reference numeral 44 denotes a sheet feed motor control circuit, which drive controls the sheet feed motor 64 in accordance with a control signal from the CPU (central processing unit) 21 obtained through the output port 26.

Reference numeral 32 denotes the input port, which is connected with the operation keys 60A to 60D. Reference numeral 36 denotes the output port, which is connected with the LEDs 61A, 61B, and the LCD 65.

Reference numeral 21 denotes the CPU in the form of a microprocessor, which controls recording operation in accordance with programs and recording instruction data stored in the program memory 24, the data memory, and the like, and instruction signals (commands) and recording information signals read from the host apparatus 100 into the working memory 25. Further, the CPU 21 instructs the drive control circuit to divide the drive period that can thoroughly drive the temperature control heaters (sub-heaters) of all the heads by the number of heads mounted on the apparatus, thereby making dispersed driving of sub-heaters of respective heads in the divided respective periods (PWM periods). Then, the CPU 21 instructs the drive control circuit to change the drive signals of sub-heaters of respective heads within the above-described PWM period in accordance with signals based on the detection temperatures outputted from the temperature sensors 10A to 10D provided in the respective heads and obtained through the A/D converter circuit 30. Further, the CPU 21 records a desired image on the recorded medium 1 (FIG. 2) by driving the recording heads 9A to 9D through the recording head drive control circuit 29 in accordance with recording information stored in the working memory 25. Reference numeral 29 denotes the recording head drive control circuit, which drive controls the recording heads 9A to 9D and supplies a pulse train determined by the CPU 21 to the sub-heaters 9A1 to 9D1 at a timing determined by the CPU 21 to pulse width modulate the sub-heaters 9A1 to 9D1.

Figure 3:
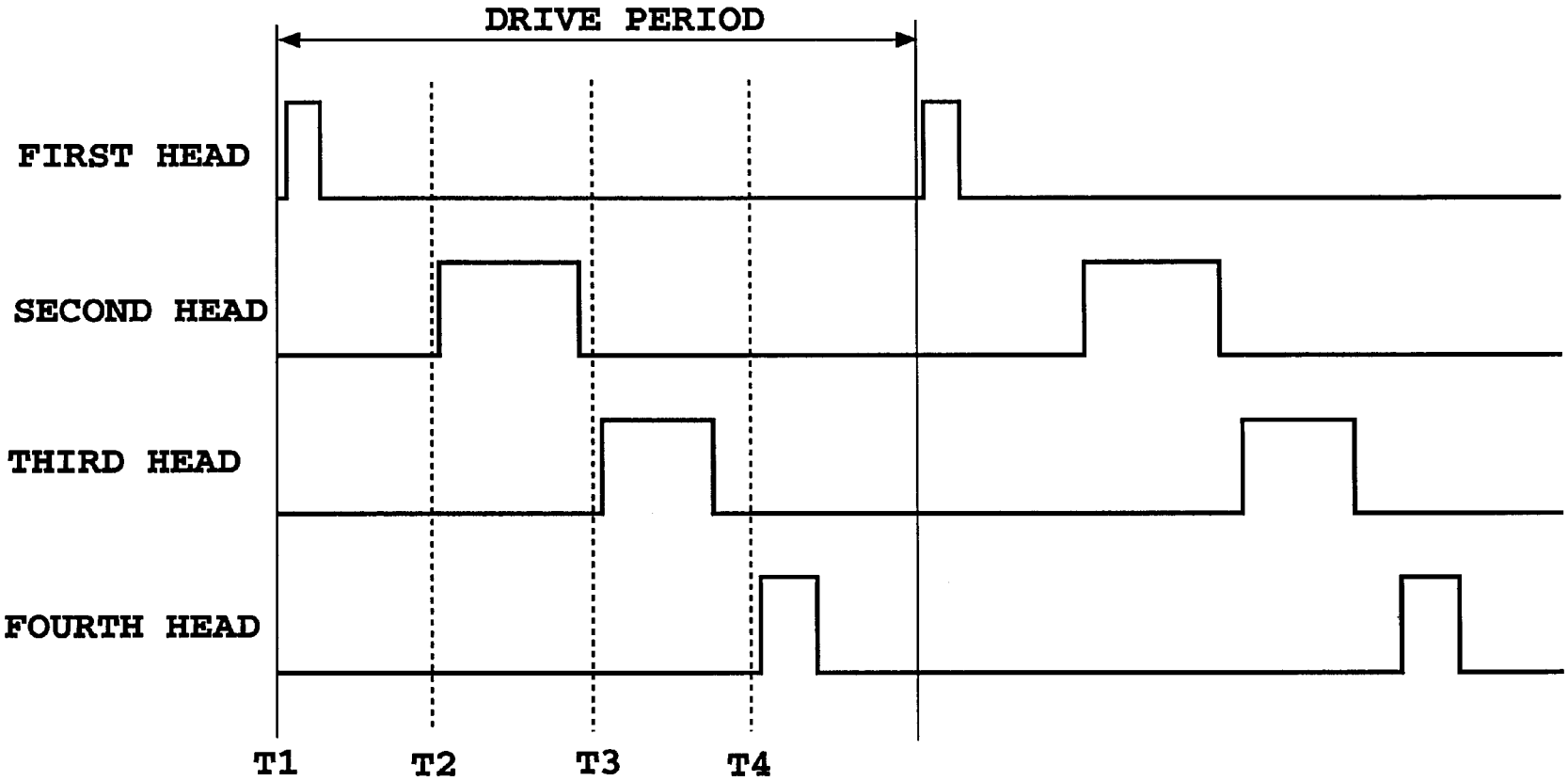
FIG. 3 is a timing chart explaining the driving signals for the recording apparatus with four recording heads.

Next, operation of the apparatus having the first through fourth heads shown in FIGS. 1 and 2 will be described. When the respective temperatures of the four recording heads 9A1 to 9D1 are detected by the respective temperature sensors 10A to 10D in the recording heads 9A to 9D, the detected temperature data are restored in the CPU 21 via the A/D converter circuit 30 and, in the CPU 21, the pulse width of the pulse train of each of the heads generated by the recording head drive control circuit 29 is ratio changed in accordance with the detected temperatures of the respective recording heads 9A to 9D. The most possible maximum pulse width by ratio change is set to the pulse width determined in accordance with the number (four) of recording heads 9A to 9D as described above. Next, pulse train supplied to the sub-heaters of the respective recording heads will be described with reference to FIG. 3. Since the present embodiment has four recording heads, the drive period is divided into four PWM periods (T1–T2, T2–T3, T3–T4, and T4-) as described above. The pulses for driving the sub-heater of each recording head are dispersed in each PWM period, so that pulses of each recording head are not overlapped. The pulses supplied to the sub-heater of each recording head are repeatedly provided in the drive period until the recording head reaches the desired temperature, as shown in FIG. 3 which shows up to the second drive period. By giving the pulses in such a way, even when the number of the recording heads is increased, the signals supplied to the sub-heaters of the respective recording heads are not overlapped, thereby preventing insufficient temperature of the recording head due to a drop of the power supply voltage.

Yet further, in the present embodiment, the pulses given to each recording head are varied within the PWM period in accordance with a detection result from the temperature detection element (temperature sensor) of each recording head. In FIG. 3, the temperature of the second recording head is the lowest, requiring more heating, and heating requirement decreasing in the order of the third, fourth, and first recording head. Therefore, voltage application to the sub-heaters 9A1 to 9D1 is dispersely (time division) drived and also time division modulated in each of the PWM period in accordance with the number of the recording heads 9A to 9D, so that the temperatures of the recording heads are increased to the optimum recording temperatures. When the optimum recording temperatures are reached, the recording heads 9A to 9D are driven by the recording head drive control circuit 29 to start the recording operation.

<Second Embodiment>

The present embodiment is different from the first embodiment in the drive control method of the sub-heaters 9A1 to 9D1. In the second embodiment, the CPU 21 judges the recording heads to be subject to temperature increase control in accordance with the signal based upon the detection signal detected by the temperature sensors 10A to 10D and obtained via the A/D converter circuit 30, determines the number of recording heads to be subject to heating control, determines the maximum pulse width (a divided width of the driving period; PWM period) of the pulse train generated by the recording head control drive circuit 29 and determines the voltage application timing so that the voltage application timing to the sub-heaters of the recording heads to be temperature controlled does not superpose.

Figure 4:
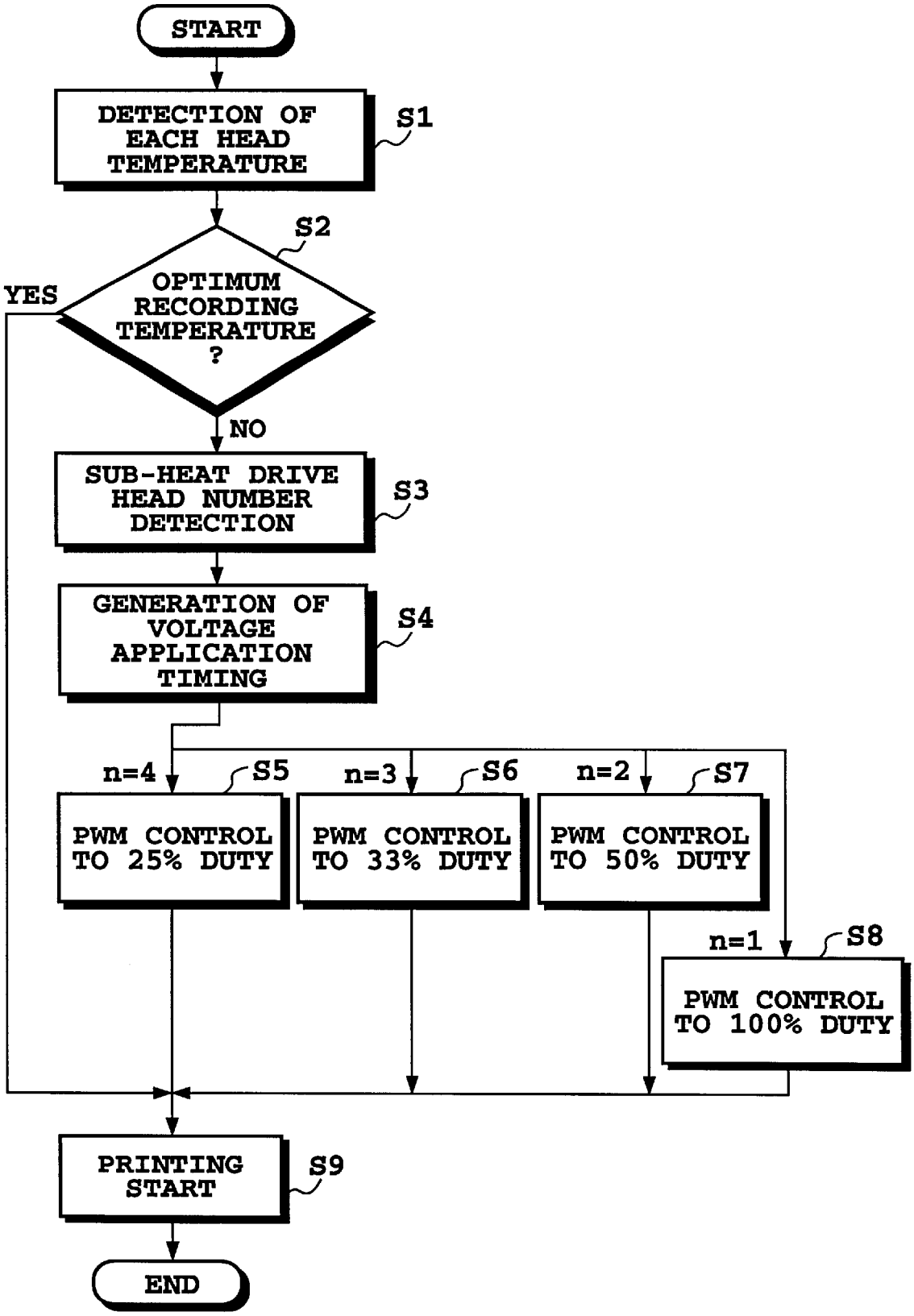
FIG. 4 is a flow chart showing an example of control program stored in a program memory 24 of FIG. 1 in a second embodiment of the present invention.

FIG. 4 is a flow chart showing an example of control program stored in the program memory 24 in FIG. 1. When recording data is transferred from the host apparatus 100 through the interface 22, and a recording start signal is transmitted from the CPU 21 through the recording head drive control circuit 29 to the recording head, this control program is started.

The temperatures of the recording heads 9A to 9D are detected by the temperature sensors 10A to 10D in the recording heads 9A to 9D (S1). The detected temperature data is restored in the CPU 21 via the A/D converter circuit 30. Then, a determination is made as to whether or not the detected temperatures are optimum recording temperatures (S2). As a result of the determination, when the result is affirmative, the recording heads 9A to 9D are driven by the recording head drive control circuit 29 to start printing operation (S9). On the other hand, when the determination result is negative, the number (n) of the recording heads to be temperature controlled is detected (S3). Then, the number of recording heads to be subject to heating control or to be heating controlled is determined, the sub-heater voltage application timing is determined in accordance with the determined number of recording heads to be heating controlled to increase their temperatures (S4). Voltage application to the sub-heaters is PWM controlled at a duty ratio in accordance with the number n of recording heads to be heating controlled to heat or increase the temperatures of the recording heads to the optimum recording temperatures (S5 to S8). Specifically, when the four recording heads are to be heat controlled, the PWM control is made at a maximum duty of 25% (S5) by dividing the driving period into four; when the three recording heads are to be heat controlled, the PWM control is made at a maximum duty of 33% (S6) by dividing the driving period into three; when the two recording heads are to be heating controlled, the PWM control is made at a maximum duty of 60% (S7) by dividing the driving period into two; and when a single recording head is to be heating controlled, the PWM control is made at a maximum duty of 100% (S5) by using the entire driving period. When the optimum recording temperatures are reached, the recording heads 9A to 9D are driven by the recording head drive control circuit 29 to start the recording operation (S9).

Figure 5:
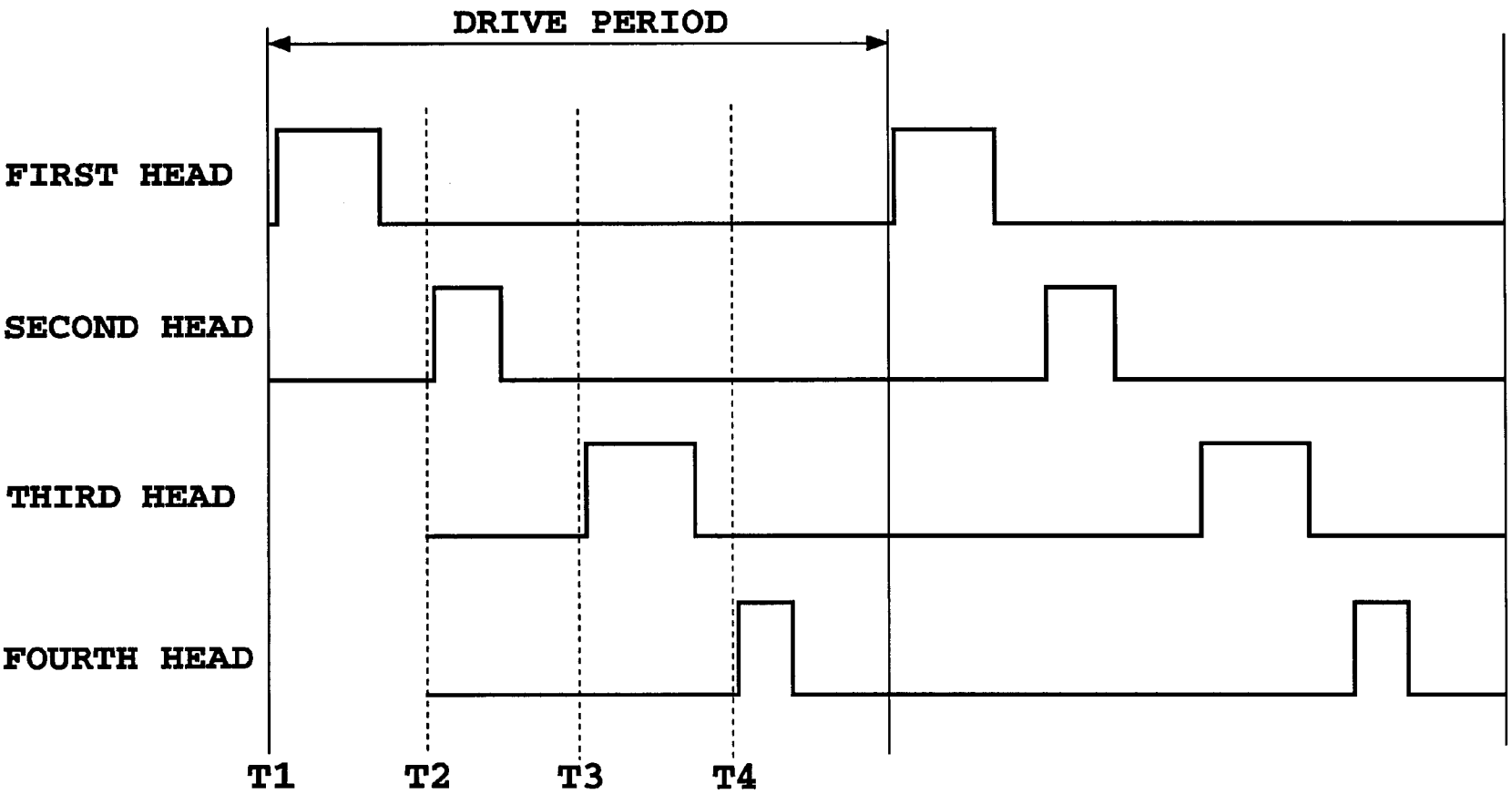
FIG. 5 is a schematic diagram for explaining sub-heater PWM control when the number of recording heads to be temperature controlled is four.
Figure 6:
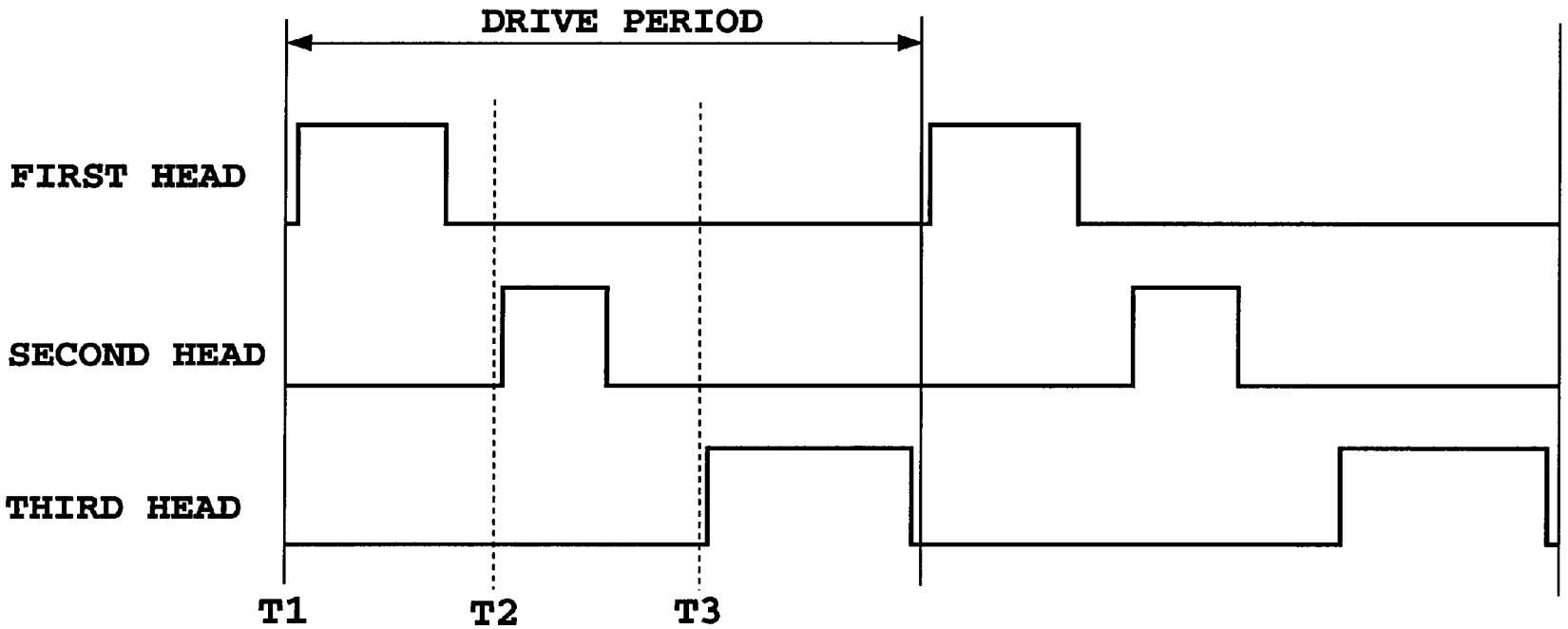
FIG. 6 is a schematic diagram for explaining sub-heater PWM control when the number of recording heads to be temperature controlled is three.
Figure 7:
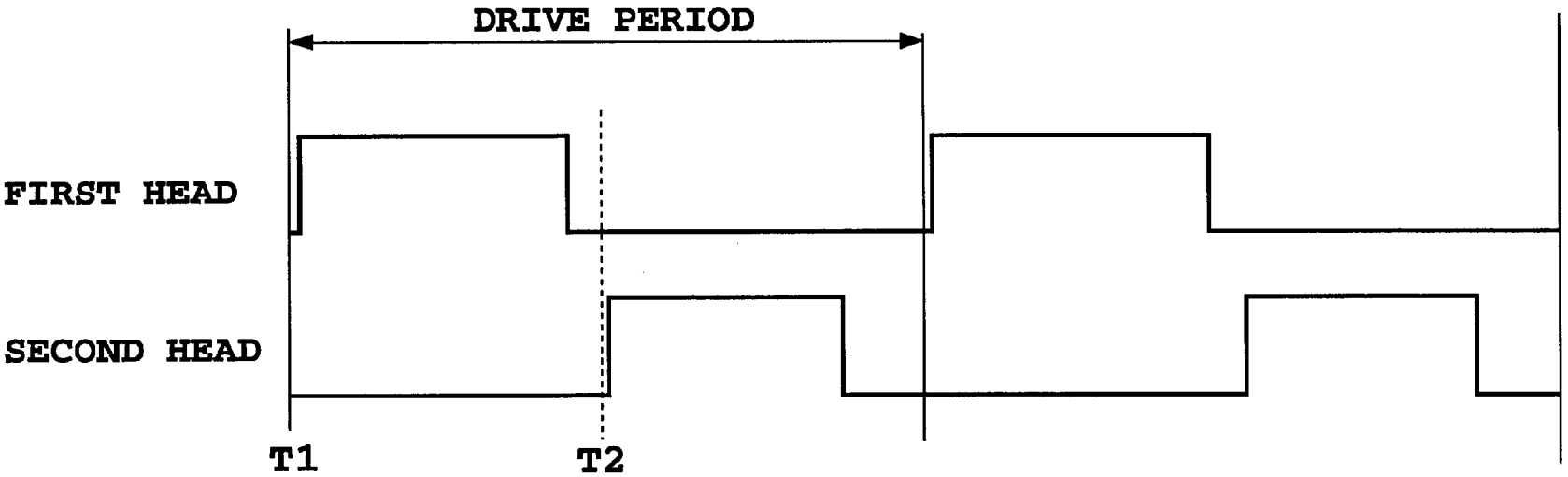
FIG. 7 is a schematic diagram for explaining sub-heater PWM control when the number of recording heads to be temperature controlled is two.
Figure 8:
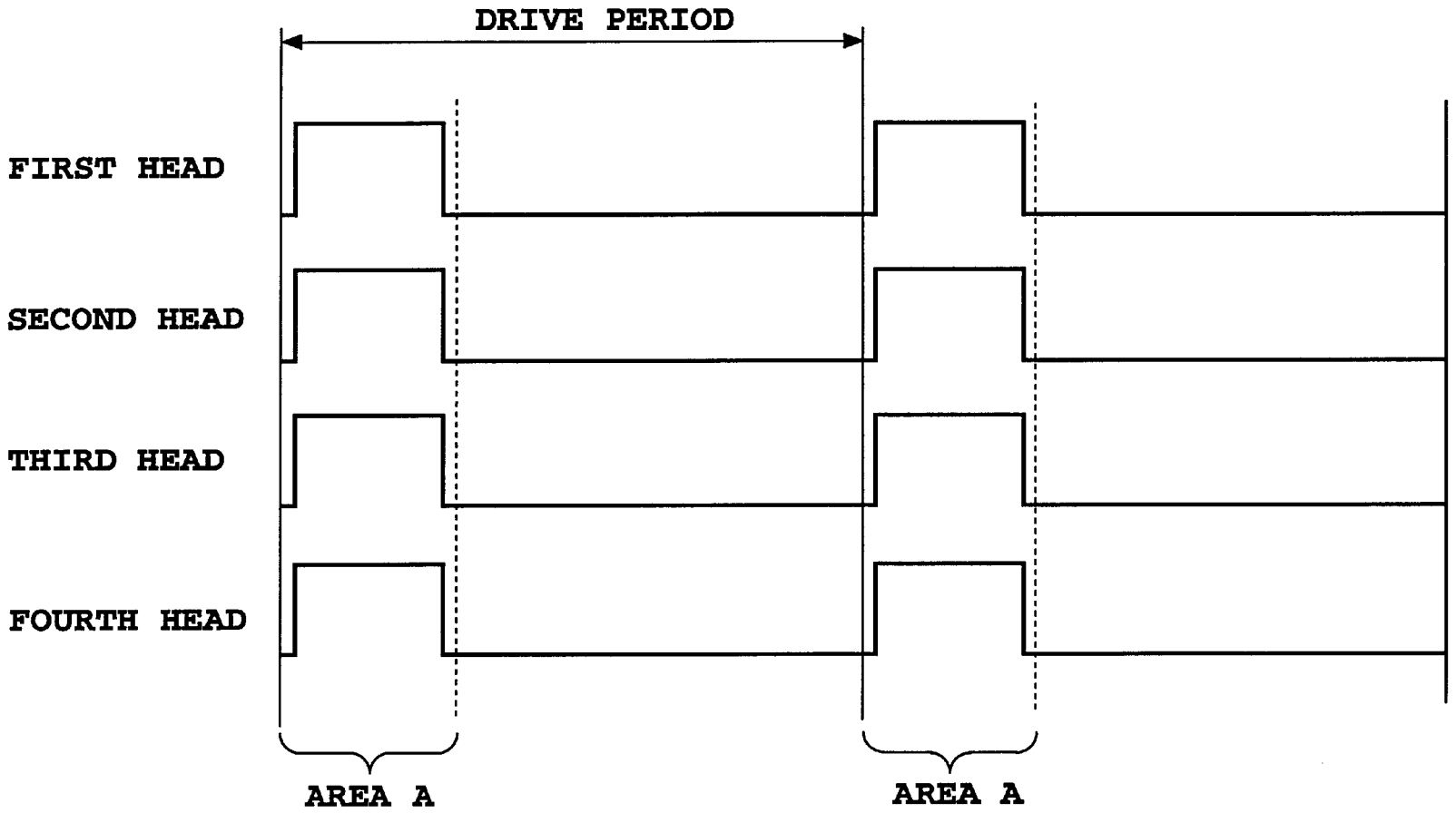
FIG. 8. is a schematic diagram for explaining a prior art example of sub-heater PWM control.

Next, the PWM control in accordance with the number of recording heads to be heating controlled will be described in detail with reference to FIGS. 5 to 7. When the number of recording heads to be heating controlled is four, a time period (PWM period of time) obtained by equally dividing the driving period by four is a maximum pulse width. As shown in FIG. 5, the sub-heater of the first recording head is applied with a voltage for a PWM period between timings T1 and T2. The sub-heater of the second recording head is applied with a voltage for a PWM period between timings T2 and T3. The sub-heater of the third recording head is applied with a voltage for a PWM period between timings T3 and T4. The sub-heater of the fourth recording head is applied with a voltage for a PWM period between timings T4 and the next T1. Thus, the PWM control is made within a maximum duty of 25%.

When the number of recording heads to be heating controlled is three, a time period (PWM period of time) obtained by equally dividing the driving period by three is a maximum pulse width. As shown in FIG. 6, the sub-heater of the first recording head is applied with a voltage for a PWM period between timings T1 and T2. The sub-heater of the second recording head is applied with a voltage for a PWM period between timings T2 and T3. The sub-heater of the third recording head is applied with a voltage for a PWM period between timings T3 and the next T1. Thus, the PWM control is made within a maximum duty of 33%.

When the number of recording heads to be heating controlled is two, a time period (PWM period of time) obtained by equally dividing the driving period by two is a maximum pulse width. As shown in FIG. 7, the sub-heater of the first recording head is applied with a voltage for a PWM period between timings T1 and T2. The sub-heater of the second recording head is applied with a voltage for a PWM period between timings T2 and the next T1. Thus, the PWM control is made within a maximum duty of 50%.

When the number of recording heads to be heating controlled is one, the driving period becomes a maximum pulse width, so that the PWM control is made at a maximum duty of 100%.

Further, in the second embodiment, as in the first embodiment, the PWM control is made for every recording head in each PWM period in accordance with the temperature of each head.

As described above, in the first and second embodiments, the drive period is divided in accordance with the number of recording heads mounted on the apparatus or those judged to require heating control to determine a PWM period, and a supply timing of the signal to the sub-heater of each recording head is dispersed in each PWM period in the drive period, so that the pulse supply timing is not overlapped even when the signal to the sub-heater of each recording head is PWM controlled and accordingly insufficient recording head temperature due to a drop of the power supply voltage can be prevented. Furthermore, since the pulse can be modulated in the PWM period for every recording head, more appropriate heating can be provided to each head.

Further, it is necessary that the number of repetitions of drive period corresponds to the number of repetitions for the recording head requiring the largest amount of heating to reach the predetermined temperature. In this case, a control is possible in which the signal application to a recording head requiring less heating is completed by the reduced number of drive periods and no other signals are applied.

However, since this leads to a rapid increase in the recording head temperature and accordingly temperature control becomes complicated, it is desirable that the signals are supplied in the dispersion manner in accordance with the maximum repetition period as shown in the above-described respective embodiments.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can also be changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As described above, in accordance with the present invention, the respective recording heads are not simultaneously applied with electrical signals, degradation of image quality due to recording head temperature can be prevented in a low-temperature environment. Furthermore, the electrical load of the apparatus can be reduced, and the capacity of the power supply can thus be decreased.

The present invention has been described in detail with respect to preferred embodiments, and it will now be apparent form the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet printer including:

a plurality of recording heads;

a plurality of heating means for respectively heating said plurality of recording heads according to a repetition of a predetermined driving period so as to adjust the temperature of each of said plurality of recording heads by heating each of the plurality of recording heads without causing ink election from the recording heads; and temperature detection means for detecting respective temperatures of said plurality of recording heads;

said ink-jet printer comprising:

pulse width control means for driving said plurality of heating means in a dispersed manner in a divided driving period determined by dividing said predetermined driving period in accordance with the number of recording heads; and pulse width changing means for changing pulse widths of pulses to be applied to said recording heads in accordance with the temperatures detected by said temperature detection means in said divided driving period.

2. The ink-jet printer as claimed in claim 1, wherein said pulse width changing means changes said pulse widths to be equal to each other.

3. An ink-jet printer as claimed in claim 1, further comprising means for generating thermal energy for ejecting ink.

4. An ink-jet printer as claimed in claim 3, wherein said means for generating thermal energy includes an electrothermal energy conversion element.

5. An ink-jet printer including:

a plurality of recording heads;

a plurality of heating means for respectively heating said plurality of recording heads so as to adjust the temperature of each of said recording heads by heating each of the plurality of recording heads without causing ink election from the recording heads;

a plurality of temperature detection means for detecting respective temperatures of said plurality of recording heads; and pulse width control means for making pulse width control over said plurality of heating means respectively at predetermined periods in accordance with temperatures detected respectively by said plurality of temperature detection means;

said ink-jet printer comprising:

judgment means for judging which recording head is required to be heated in accordance with temperatures detected by said plurality of temperature detection means;

counting means for counting the number of recording heads required to be heated in accordance with a judgment result of said judgment means;

possibly maximum pulse width determination means for determining a possibly maximum pulse width of a pulse generated by said pulse width control means in accordance with the number of recording heads counted by said counting means;

pulse width change means for respectively changing the pulse width of a pulse to be supplied to said heating means of said recording head required to be heated within the possibly maximum pulse width; and timing shift means for successively shifting timings at which the pulse having a pulse width changed by said pulse width change means are supplied respectively to the heating means corresponding to said recording head required to be heated by said possibly maximum pulse width.

6. The ink-jet printer as claimed in claim 5, wherein said determination means determines a recording head having a temperature detected by said plurality of temperature detection means being lower than a predetermined temperature as a recording head required to be heated.

7. The ink-jet printer as claimed in claim 6, wherein said predetermined temperature is an optimum recording temperature.

8. The ink-jet printer as claimed in claim 5, wherein said determination means judges a recording head required to be heated when recording is started.

9. The ink-jet printer as claimed in claim 5, wherein said possibly maximum pulse width is a pulse width obtained by equally dividing said predetermined period by the number of recording heads counted by said counting means.

10. The ink-jet printer as claimed in claim 5, further comprising recording start control means for immediately starting recording when the number of recording heads required to be heated is zero as a result of counting by said counting means, and starting recording when the temperature control of said recording head required to be heated is completed when the number is 1 or more.

11. An ink-jet printer as claimed in claim 5, further comprising means for generating thermal energy for ejecting ink.

12. An ink-jet printer as claimed in claim 11, wherein said means for generating thermal energy includes an electrothermal energy conversion element.

13. An ink-jet printer comprising:

a plurality of recording heads;

a plurality heating means for respectively heating said plurality of recording heads so as to adjust the temperature of each of said recording heads by heating each of the Plurality of recording heads without causing ink election from the recording heads;

a plurality of temperature detection means for detecting respective temperatures of said plurality of recording heads; and pulse width control means for making pulse width control over said plurality of heating means respectively at predetermined periods in accordance with temperatures detected respectively by said plurality of temperature detection means;

said ink-jet printer comprising:

judgment means for judging which recording head is required to be heated in accordance with temperatures detected by said plurality of temperature detection means;

counting means for counting the number of recording heads required to be heated in accordance with a judgment result of said judgment means;

maximum duty ratio determination means for determining a maximum duty ratio of pulse train generated by said pulse width control means corresponding to said recording head required to be heated in accordance with the number of recording heads counted by said counting means;

duty ratio change means for changing, within the maximum duty ratio, a duty ratio of a pulse train generated by said pulse width control means corresponding to the number of recording heads required to be heated; and timing shift means for successively shifting timings at which the pulse train having a duty ratio changed by said duty ratio change means are supplied respectively to the heating means corresponding to said recording head required to be heated by the maximum duty ratio.

14. The ink-jet printer as claimed in claim 13, wherein said determination means determines a recording head having a temperature detected by said plurality of temperature detection means being lower than a predetermined temperature as a recording head required to be heated.

15. The ink-jet printer as claimed in claim 14, wherein said predetermined temperature is an optimum recording temperature.

16. The ink-jet printer as claimed in claim 13, wherein said determination means judges a recording head required to be heated when recording is started.

17. The ink-jet printer as claimed in claim 13, wherein said maximum duty ratio is obtained by equally dividing said predetermined period by the number of recording heads counted by said counting means and by dividing the resulting time by said predetermined period.

18. The ink-jet printer as claimed in claim 13, further comprising recording start control means for immediately starting recording when the number of recording heads required to be heated is zero as a result of counting by said counting means, and starting recording when the temperature control of recording head required to be heated is completed when the number is 1 or more.

19. An ink-jet printer as claimed in claim 13, further comprising means for generating thermal energy for ejecting ink.

20. An ink-jet printer as claimed in claim 19, wherein said means for generating thermal energy includes an electrothermal energy conversion element.

21. A temperature control method for recording heads comprising the steps of:

detecting respective temperatures of a plurality of recording heads respectively having pulse width controlled heating means for adjusting the temperature of each of said recording heads by heating each of the plurality of recording heads without causing ink election from the recording heads;

counting the number of recording heads required to be heated of said recording heads;

determining a possibly maximum pulse width in accordance with the number of recording heads required to be heated;

changing, within the possibly maximum pulse width pulse widths supplied to said heating means in accordance with the temperatures detected; and successively shifting timings at which the pulses having ratio changed pulse widths are supplied to said heating means for said recording head required to be heated by said determined possibly maximum pulse width.

22. The temperature control method for recording heads as claimed in claim 21, wherein said changing step includes the step of changing the pulse widths to be equal to each other.

23. A temperature control method as claimed in claim 21, further comprising a step of ejecting ink by a thermal energy generating means.

24. A temperature control method as claimed in claim 23, wherein said thermal energy generating means includes an electorthermal energy conversion element.

25. A temperature control method for recording heads comprising the steps of:

detecting respective temperatures of a plurality of recording heads each having pulse width controlled heating means for adjusting the temperature of each of said recording heads by heating each of the plurality of recording heads without causing ink election from the recording heads;

judging which recording head is a recording head required to be heated in accordance with the detected temperature;

determining the number of recording heads required to be heated in accordance with the judgment result;

determining a possibly maximum pulse width of a pulse supplied to said heating means in accordance with the determined number of recording heads;

respectively changing a pulse width of the pulse supplied to heating means corresponding to a recording head required to be heated within the determined possibly maximum pulse width; and successively shifting timing at which the pulse width controlled pulses each having changed pulse width are supplied respectively to said heating means corresponding to said recording head required to be heated by said determined possibly maximum pulse width.

26. A temperature control method as claimed in claim 25, further comprising a step of ejecting ink by a thermal energy generating means.

27. A temperature control method as claimed in claim 26, wherein said thermal energy generating means includes an electorthermal energy conversion element.

28. A temperature control method for recording heads comprising the steps of:

detecting respective temperatures of a plurality of recording heads each having pulse width controlled heating means for adjusting the temperature of each of said recording heads by heating each of the plurality of recording heads without causing ink election from the recording heads;

judging which recording head is a recording head required to be heated in accordance with the detected temperature;

determining the number of recording heads required to be heated in accordance with the judgment result;

determining a maximum duty ratio of a pulse train supplied to said heating means corresponding to said recording head required to be heated in accordance with the determined number of recording heads;

changing a duty ratio of the pulse supplied to heating means corresponding to a recording head required to be heated within the determined maximum duty ratio; and successively shifting timings at which the pulse width controlled pulse trains having ratio changed duty ratios are supplied to heating means corresponding to said recording head required to be heated by a time in accordance with said determined maximum duty ratio.

29. A temperature control method as claimed in claim 18, further comprising a step of ejecting ink by a thermal energy generating means.

30. A temperature control method as claimed in claim 29, wherein said thermal energy generating means includes an electorthermal energy conversion element.

* * * * *

UNITED STATES PATENT AND TRADEMARK OFFICE

CERTIFICATE OF CORRECTION

PATENT NO. : 6,276,776 B1
DATED : August 21, 2001
INVENTOR(S) : Umezawa et al.

It is certified that error appears in the above-identified patent and that said Letters Patent is hereby corrected as shown below:

Title page,
Item [56], References Cited, U.S. PATENT DOCUMENTS, "4,459,600" should read -- 4,456,600 --.

Column 1,
Line 7, "fereinto" should read -- hereinto --.

Column 10,
Line 66, "election" should read -- ejection --.

Column 11,
Line 29, "election" should read -- ejection --.

Column 12,
Line 26, "plurality" should read -- plurality of --; and
Line 30, "election" should read -- ejection --.

Column 13,
Line 33, "election" should read -- ejection --; and
Line 57, "electorthermal" should read -- electrothermal --.

UNITED STATES PATENT AND TRADEMARK OFFICE

CERTIFICATE OF CORRECTION

PATENT NO. : 6,276,776 B1
DATED : August 21, 2001
INVENTOR(S) : Umezawa et al.

It is certified that error appears in the above-identified patent and that said Letters Patent is hereby corrected as shown below:

Column 14,
Lines 2 and 35, "election" should read -- ejection --; and
Lines 28 and 60, "electorthermal" should read -- electrothermal --.

Signed and Sealed this

Fourteenth Day of May, 2002

*Attest:*

*Attesting Officer*

JAMES E. ROGAN
*Director of the United States Patent and Trademark Office*